United States Patent [19]

Preu

[11] 3,982,371

[45] Sept. 28, 1976

[54] PANEL HOLDING STRUCTURE

[75] Inventor: Willi Preu, Dubuque, Iowa

[73] Assignee: Scovill Manufacturing Company, Dubuque, Iowa

[22] Filed: May 2, 1973

[21] Appl. No.: 356,293

[52] U.S. Cl. ..... 52/498
[51] Int. Cl.[2] ..... E06B 3/58
[58] Field of Search ..... 52/403, 498, 502, 476, 52/499, 500

[56] References Cited

UNITED STATES PATENTS

| | | | |
|---|---|---|---|
| 2,642,632 | 6/1953 | Savage | 52/502 X |
| 2,841,836 | 7/1958 | Watson | 52/498 |
| 3,144,689 | 8/1964 | Mignault et al. | 52/502 |
| 3,363,385 | 1/1968 | Evans et al. | 52/498 |
| 3,455,080 | 7/1969 | Meadows | 52/476 |
| 3,487,601 | 1/1970 | James | 52/498 X |
| 3,668,830 | 6/1972 | Frank | 52/502 X |

*Primary Examiner*—Price C. Faw, Jr.
*Attorney, Agent, or Firm*—Hofgren, Wegner, Allen, Stellman & McCord

[57] ABSTRACT

A panel holding structure for a panel such as a glass window pane that includes a frame, a retaining step on the frame against which the panel is pressed, an elongated glazing stop engaging a side of the panel that is opposite the step with the glazing stop having a rigid stem positioned in a groove in the frame and extending therefrom adjacent to the surface of the panel that is opposite the step, pressure devices on the stem both within the groove and externally thereof and engaging both the panel and the groove surface for aid in retaining the stem in the groove and the panel against the step and a rigid flange on this stem extending away from the panel and overlying and engaging a portion of the frame that is adjacent the groove for resisting outward movement of the glazing stop by the pressure of the window thereagainst. The disclosure also includes the device including the elongated glazing stop that engages the panel and retains it upon a frame.

1 Claim, 2 Drawing Figures

PANEL HOLDING STRUCTURE

BACKGROUND OF THE INVENTION

One of the features of this invention is to provide an improved panel holding structure for retaining a panel such as a glass window pane in a frame in which the panel is held in position against a step on the frame by a glazing stop that is releasably held in a groove in the frame and that has a part bearing against the frame so that the step is substantially unyieldable away from the panel.

Another feature of the invention is to provide a device for engaging the edge of a panel and fixing the panel upon a frame, this device comprising an elongated glazing stop means for engaging a side surface of the panel, the stop means having a rigid stem for positioning in a groove in the frame and extending outwardly thereof adjacent a side surface of the panel, spaced yieldable pressure means on the stem for bearing against the panel and a groove defining surface and a rigid flange on the stem for overlying the portion of the frame that is adjacent the groove and thereby resisting movement of the device away from the panel.

DESCRIPTION OF THE PREFERRED EMBODIMENT

Figure 1:
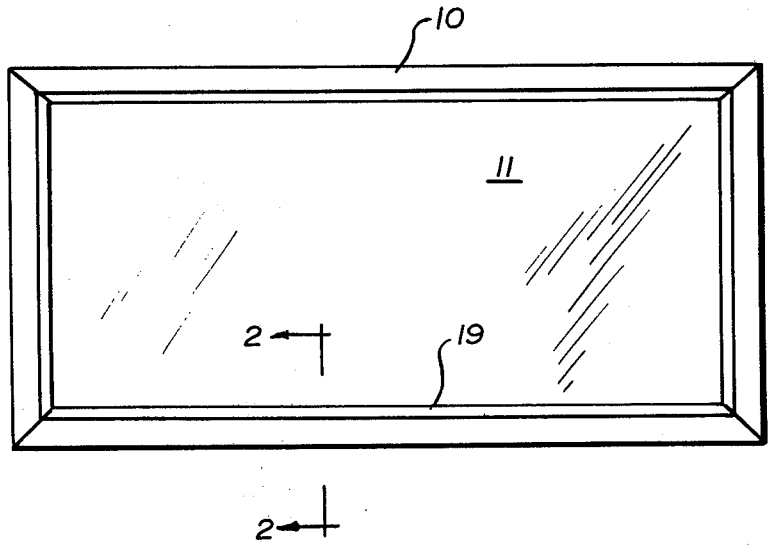
FIG. 1 is a side elevational view of a window that includes a frame and a glass pane held therein and embodying the invention.

In the embodiment illustrated in the drawings the frame 10 releasably retains a panel 11 which in the illustrated embodiment comprises a glass window pane.

Figure 2:
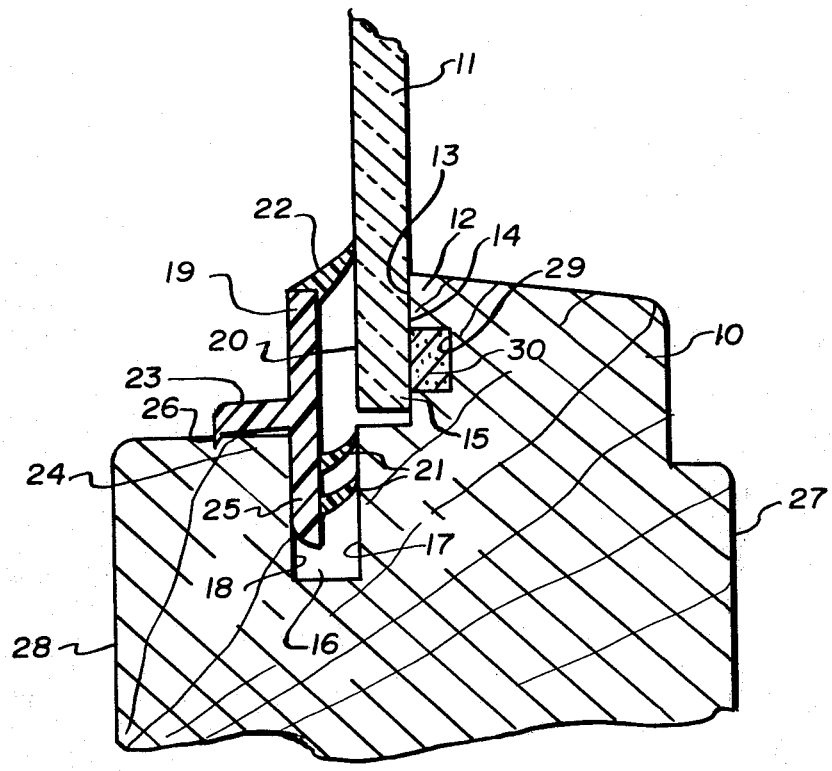
FIG. 2 is a fragmentary enlarged sectional view taken substantially along line 2—2 of FIG. 1.

The frame 10 as is illustrated in FIG. 2 may be made of wood although any other material of construction can be used. This frame is provided with a step means 12 comprising a vertical surface 13 that engages a first side surface 14 of an edge 15 of the panel 11. The frame 10 has formed therein a groove 16 that is defined by opposite surfaces 17 and 18 with the groove being located adjacent to and outwardly of the step 12.

In order releasably to hold the panel 11 in position against the surface 13 of the step 12 there is provided an elongated glazing stop in the form of a rigid stem 19 which is preferably made of a rigid plastic such as polyvinyl chloride. This glazing stop stem 19 engages the opposite side surface 20 of the panel edge 15 and for ready reference the side surface 14 is herein identified as the first side surface while the side surface 20 is identified as the second side surface.

As can be seen in FIG. 2, the stem 19 is releasably positioned in the groove 16 and extends therefrom adjacent to the panel edge 15 at the second side surface 20 of the panel. Yieldable pressure means in the form of flexible tapered or feathered flanges 21 and 22 are provided with the flanges 21 bearing against the side surface 17 of the groove 16 and the flange 22 bearing against the adjacent second side surface 20 of the panel 11. These resilient and tapered flanges 21 and 22 are preferably made integral with the rigid stem 19 and may also comprise polyvinyl chloride. The flexible flanges 21 and 22 aid in retaining the stem 19 fixed in the groove 16 and also aid in retaining the panel edge 15 against the surface 13 of the step 12.

In order to lock the stem 19 in position it is provided with a rigid integral flange 23 that overlies and engages a portion 24 of the frame 10 that is adjacent to the groove 16. The flange 23 that is integral with the remainder of the stem 19 is angled to somewhat less than 90° to the groove engaging end 25 of the stem so as to snugly embrace the portion 24 of the frame.

In a preferred construction the outer extremity of the flange 23 on the side thereof that engages the frame portion 24 is provided with a sharp edge 26 in the form of a spur. The flange 23 in the illustrated embodiment is at about an 85° angle to the groove engaging end 25 of the stem 19. The flange resists outward movement of the stem so as to hold the flexible part 22 of the stem tightly pressed against the panel 11. The sharp edge 26 insures proper fit and tight contact with the frame 10 which in this instance is a window sash.

The stem 19 is rounded on the end that is within the groove 16 as illustrated in FIG. 2 for aid in inserting the glazing stop within the groove.

In the illustrated embodiment the window structure including the frame 10 has an outer surface 27 on the exterior of the building and an inner surface 28 facing the interior. Thus the panel holding structure including the glazing stop stem 19 is easily accessible from the interior for ease in reglazing when such is desired.

In order to provide an exterior seal the frame 10 has a groove 29 adjacent the first or outer side surface 14 of the panel 11 in which is located a bedding adhesive 30 for proper adhering of the adhesive. This adhesive results in a weatherproof seal for the outer surface 14 of the panel 11 and may be any of the well known materials customarily used in this field such as rubber cement.

The glazing stop stem is easily installed in position to retain the panel 11 and when reglazing is necessary is easily removed for reuse.

As can be seen in FIG. 2, the panel edge 15 preferably has a thickness that substantially spans the distance between the groove 16 and the step surface 13. The flexible flanges 21 and 22 which engage the groove surface 17 and the panel surface 20 have reaction forces with a component urging the stem 19 into the groove and the flange 23 against the frame portion 24. Thus, as illustrated, the flexible flanges 21 and 22 when distorted in position extend upwardly in the illustrated embodiment so that the reactive force presses the stem 19 downwardly or toward the bottom of the groove 16.

I claim:

1. A panel holding structure, comprising: a frame; retaining step means on said frame for engaging a first side surface of an edge of said panel, the frame having a groove defined by spaced surfaces and located adjacent to said step means; and an elongated glazing stop engaging a second side surface of said panel edge, the glazing stop having a rigid stem positioned in said groove and extending therefrom adjacent to said second side surface of said panel, yieldable pressure means on said stem engaging said panel and one said groove surface for aid in retaining said stem in said groove and said panel against said step means, and a rigid flange extending from said stem adjacent to and overlying and engaging a portion of said frame adjacent said groove and on the side thereof opposite to said retaining step means, said frame portion and adjacent said groove surface being arranged at a first angle, and said rigid flange and rigid stem being arranged at a second angle embracing and smaller than said first angle, said frame portion having a surface adjacent said groove, and said flange being provided with an integral elongated sharp spur edge in pressure engagement with said frame portion surface.

* * * * *